United States Patent [19]

Tanaka et al.

[11] Patent Number: 4,959,973

[45] Date of Patent: Oct. 2, 1990

[54] THERMOSTATIC EXPANSION VALVE

[75] Inventors: Hazime Tanaka, Yokohama, Japan; Ernest W. Schumacher, Ovilla, Tex.

[73] Assignee: Fuji Koki Manufacturing Co., Ltd., Japan

[21] Appl. No.: 355,160

[22] Filed: May 22, 1989

[30] Foreign Application Priority Data

May 23, 1988 [JP] Japan ..... 63-125499

[51] Int. Cl.[5] ..... F25B 41/04

[52] U.S. Cl. ..... 62/225; 236/52 B

[58] Field of Search ..... 62/225; 236/92 B; 137/486

[56] References Cited

U.S. PATENT DOCUMENTS

| | | | |
|---|---|---|---|
| 596,601 | 1/1898 | Knox | 236/92 B |
| 2,099,085 | 11/1937 | Shrode | 62/225 X |
| 2,579,034 | 12/1951 | Dube et al. | 236/92 B X |
| 3,402,566 | 9/1968 | Leimbach | 62/225 X |
| 4,158,437 | 6/1979 | Nielsen | 236/92 B |
| 4,342,421 | 8/1982 | Widdowson | 236/92 B |

*Primary Examiner*—William E. Tapolcai

*Attorney, Agent, or Firm*—Brown, Martin, Haller & McClain

[57] ABSTRACT

A thermostatic expansion valve located at the inlet of an evaporator in the refrigeration apparatus has a valve housing supporting a diaphragm in its sealed space. Pressure from a thermal bulb is applied on the upper surface of the diaphragm, and pressure of a reduced-pressure refrigerant in the inlet of the evaporator is applied on the lower surface of the diaphragm through on equalizing signal passage extending from a refrigerant passage formed in the housing to the sealed space in the housing. In the refrigerant passage, a valve seat is formed. The equalizing signal passage is opened at the passage in the downstream side of the valve seat. A sectional area of the refrigerant passage between the passage side opening of the signal passage and the valve seat is larger than that of the refrigerant passing hole of the valve seat but smaller than that of the refrigerant passage at a position remoter from the valve seat than the passage side opening of the signal passage.

6 Claims, 2 Drawing Sheets

THERMOSTATIC EXPANSION VALVE

BACKGROUND OF THE INVENTION

1. Field of the Invention

The present invention relates to a thermostatic expansion valve which is used in the refrigeration apparatus and is provided with a diaphragm serving to receive at one side surface thereof the pressure of an operating fluid fed from a thermal bulb located at the outlet of an evaporator of the refrigeration apparatus, the other side surface of the diaphragm being connected to a valve mechanism, wherein when the diaphragm is displaced responsive to any change in the pressure of the operating fluid, the valve mechanism is controlled in accordance with a change in a difference between the pressure applied to the one and the other side surfaces of the diaphragm, by the displacement of the diaphragm produced by the change in the pressure difference, to control the flow rate of refrigerant flowing into the evaporator. More particularly, it relates to a thermostatic expansion valve which has a valve housing supporting the diaphragm and having a refrigerant passage and a valve seat formed in the refrigerant passage, the refrigerant passage being connected at its one end to the inlet of the evaporator and being supplied at its other end with a highly pressurized fluid flowing from a compressor of the refrigeration apparatus, the valve seat being controlled the valve opening thereof by a valve body of the valve mechanism, and the valve housing further comprising an equalizing-signal passage for introducing a pressure-reduced refrigerant, which is reduced in pressure by a co-operation between the valve body of the valve mechanism and the valve seat of the valve housing, from a pressure-reduced-refrigerant outlet space located at the downstream side of the valve seat in the refrigerant passage to the other side surface of the diaphragm.

The thermostatic expansion valve of this type was conventionally used, for example, in a refrigeration apparatus for an air-conditioner of a small-sized car. This kind of thermostatic expansion valve is simpler in construction, easy to assemble, and lower in cost, as compared with those conventional ones which use an equalizing pipe instead of the equalizing-signal passage to introduce the superheated refrigerant vapor from the outlet of the evaporator to the other side surface of the diaphragm.

In a case that the difference between the superheated vapor pressure of the refrigerant at the outlet of the evaporator and the pressure of the refrigerant at the inlet of the evaporator is small due to that the flow rate of the refrigerant is small in the refrigeration apparatus and the pressure loss of the refrigerant is small in the evaporator, the simply constructed thermostatic expansion valve can appropriately control the flow rate of the refrigerant to the evaporator without causing any larger error as compared with the above-mentioned conventional thermostatic expansion valve of the other type which uses the superheated vapor pressure of the refrigerant at the outlet of the evaporator. Namely, the flow rate of the refrigerant flowing to the inlet of the evaporator can be controlled in such a way that the degree of the superheat of the refrigerant at the outlet of the evaporator keeps at a predetermined value to enable the refrigeration apparatus to achieve the optimum refrigerating efficiency.

In this simply constructed thermostatic expansion valve, however, the flow rate of the refrigerant supplied to the evaporator is smaller than that in the case of the above-mentioned conventional thermostatic expansion valve of the other type which use the superheated vapor pressure of the refrigerant at the outlet of the evaporator, when the difference between the superheated vapor pressure of the refrigerant at the outlet of the evaporator and the pressure thereof at the inlet of the evaporator becomes large due to that the flow rate of the refrigerant in the refrigeration apparatus becomes large and the pressure loss in the evaporator becomes large. More specifically, the degree of superheat of the refrigerant at the outlet of the evaporator becomes higher than the optimum value at the time when the refrigeration apparatus achieves the optimum refrigerating efficiency. This prevents the refrigeration apparatus from being operated at its optimum refrigerating efficiency.

U.S. Pat. No. 4,342,421 discloses another well-known thermostatic expansion valve to eliminate the above-mentioned drawback caused in the case that the flow rate of the refrigerant in the refrigeration apparatus becomes large in the above mentioned simply constructed thermostatic expansion valve. The construction of the expansion valve of USP is schematically shown in FIG. 1.

This thermostatic expansion valve, similar to the ones of the same type to which no improvement was added, has right-angled "T" shaped valve housing 10 and diaphragm 12 is housed in a sealed space in the upper extended end portion of valve housing 10. Thermal bulb 14 is connected to the upper extended end portion of valve housing 10 at the upper side of diaphragm 12. Valve-body driving pin 16 of a valve mechanism connected to the undersurface of diaphragm 12 extends toward the lower extended end portion of valve housing 10 in valve housing 10. Refrigerant passage 18 extends like a reversed "L" shape from the lower extended end surface of the lower extended end portion to the side extended end surface of the side extended end portion, and valve seat 20 of the valve mechanism is mounted at the inner end of lower extended area **18*a* of refrigerant passage 18. The lower end of valve-body driving pin 16 is inserted into a center hole of valve seat 20, and contacts valve body 24 of the valve mechanism which is located at the lower extended area 18*a* of refrigerant passage 18 and is urged by urging means 22 to sit on valve seat 20** from below.

Lower extended area **18*a* of refrigerant passage 18 is connected to a compressor (not shown) through a condenser (not shown) and is supplied with highly pressurized refrigerant from the compressor. The highly pressurized refrigerant in lower extended area 18*a* is reduced in pressure while passing through valve seat 20 to enter into side extended area 18*b* of refrigerant passage 18, and the pressure-reduced refrigerant further passes through side extended area 18*b* and flows to the inlet of an evaporator (not shown) connected to side extended area 18*b*. Side extended area 18*b* which serves as a pressure-reduced refrigerant outlet space in this manner is communicated with a diaphragm-sealed space on the other side of diaphragm 12 through equalizing signal passage 26 extending through the upper extended end portion of housing 10**.

The thermostatic expansion valve disclosed in the U.S. Patent is different from the no-improved ones of the same type in that side extended area **18*b* serves as a venturi tube. More specifically, side extended area 18*b* is a stepped hole having a small-diameter portion located more inside the opening of equalizing signal passage 26 and a large-diameter portion located more outside the opening of equalizing signal passage 26. Ring-shaped cylinder 28 is formed on the stepped portion of area 18*b* to coaxially project toward the large-diameter portion of area 18*b*. The outer circumferential surface of cylinder 28 radially faces the opening of equalizing signal passage 26, and equalizing signal passage 26 is communicated with the outer large-diameter portion of side extended area 18*b* through a ring-shaped clearance formed between the inner circumferential surface of the outer large-diameter portion and the outer circumferential surface of cylinder 28**.

In this case, when the pressure-reduced refrigerant which is reduced in pressure by flowing from lower extended area **18*a* into valve seat 20 toward side extended area 18*b* flows from the inner small-diameter portion surrounded by cylinder 28 to the outer large-diameter portion at side extended area 18*b*, the velocity of the refrigerant becomes faster at the vicinity of the projected end of cylinder 28 than in the center of cylinder 28. As the result, pressure in equalizing signal passage 26 becomes lower as the flow rate of the pressure-reduced refrigerant flowing into side extended area 18*b*** becomes larger.

This decrease of pressure in equalizing signal passage 26 which is loaded on diaphragm 12 instead of the superheated vapor pressure of the refrigerant at the outlet of the evaporator can compensate the increase of the difference between the superheated vapor pressure of the refrigerant at the outlet of the evaporator and the pressure of the refrigerant at the inlet of the evaporator, said increase of the difference being caused as the flow rate of the pressure-reduced refrigerant flowing into side extended area 18 becomes larger. Namely, the difference between the superheated vapor pressure of the refrigerant at the outlet of the evaporator and the pressure of the refrigerant at the inlet of the evaporator, which is caused by the increase of pressure loss of the refrigerant in the evaporator resulting from the increase of the flow rate of the refrigerant, can be made zero by this decrease of pressure in equalizing hole 26 at the inlet of the evaporator. Therefore, the flow rate of the refrigerant flowing to the inlet of the evaporator can be controlled to keep the degree of the superheat of the superheated refrigerant vapor at the outlet of the evaporator constant and to enable the refrigeration apparatus to achieve the optimum refrigerating efficiency.

However, the thermostatic expansion valve disclosed in the U.S. Patent makes it difficult to work side extended area **18*b* of refrigerant passage 18 where cylinder 28 is formed, and also to work equalizing signal passage 26 which faces the outer circumferential surface of cylinder 28. Further, the ring-shaped clearance, formed between the inner circumferential surface of the outer large-diameter portion of side extended area 18*b* of refrigerant passage 18 at which equalizing signal passage 26 is opened and the outer circumferential surface of cylinder 28, makes the flow of the pressure-reduced refrigerant at side extended area 18*b* being turbulent to make noises. In addition, this turbulent flow suddenly changes the pressure in equalizing signal passage 26** for a short time period, thereby changing for a short time period the controlling of the flow rate of the refrigerant flowing to the inlet of the evaporator.

SUMMARY OF THE INVENTION

The present invention is intended to eliminate the above-mentioned drawbacks and the object of the present invention is therefore to provide a thermostatic expansion valve, simple in construction and easy to make and assemble, having an equalizing signal passage in a valve housing and capable of compensating the increase of the difference between superheated refrigerant vapor pressure at the outlet of an evaporator and the pressure of the refrigerant at the inlet of the evaporator when the flow rate of refrigerant becomes large to control the flow rate of the refrigerant flowing to the inlet of the evaporator in such a manner that the degree of the superheat of the superheated refrigerant vapor at the outlet of the evaporator keeps constant and that the refrigeration apparatus can achieve its optimum refrigerating efficiency, and also capable of effectively suppressing noises while the thermostatic expansion valve is being used.

The object of the present invention can be achieved by a thermostatic expansion valve comprising: a valve housing which serves to support the diaphragm and has a refrigerant passage connected at its one end to an inlet of an evaporator and supplied at its other end with high pressurized refrigerant flowing from a compressor in a refrigeration apparatus, a valve seat formed in the refrigerant passage to control the flow rate of the refrigerant flowing from the compressor, in co-operation with a valve body of a valve mechanism, and an equalizing signal passage for introducing the pressure-reduced refrigerant, which has been reduced in pressure by the cooperation of the valve body of the valve mechanism with the valve seat in the refrigerant passage, from a pressure-reduced refrigerant outlet space located at the downstream side of the valve seat in the refrigerant passage to the other side surface of the diaphragm; and means, located in the pressure-reduced refrigerant outlet space, for accelerating the velocity of the pressure-reduced refrigerant. The accelerating means is constructed by setting a sectional area of the pressure-reduced refrigerant outlet space in a direction substantially perpendicular to the moving direction of the pressure-reduced refrigerant is larger than the sectional area of a refrigerant passing hole in the valve seat between the opening of the equalizing signal passage on the side of the pressure-reduced refrigerant outlet space and the valve seat, but smaller than the sectional area of the pressure-reduced refrigerant outlet space at a position remoter from the valve seat than the opening of the equalizing signal passage on the side of the pressure-reduced refrigerant outlet space.

The accelerating means constructed by the pressure-reduced refrigerant outlet space dimensioned in this manner can create venturi effect in the pressure-reduced refrigerant outlet space. As described above, this venturi effect serves to compensate the increase of the difference between the superheated refrigerant vapor pressure at the outlet of the evaporator and the pressure of the refrigerant at the inlet of the evaporator caused by the increase of the flow rate of the refrigerant. This enables the thermostatic expansion valve to control the flow rate of the refrigerant flowing to the inlet of the evaporator in such a way that the degree of the superheat of the refrigerant vapor at the outlet of the evaporator can be constant and that the refrigeration apparatus can achieve its optimum refrigerating efficiency.

A sectional area, which is larger than that of the refrigerant passing hole in the valve seat but smaller than that of the pressure-reduced refrigerant outlet space at a position remoter from the valve seat than the opening of the equalizing signal passage on the side of the pressure-reduced refrigerant outlet space, is located in the pressure-reduced refrigerant outlet space between the opening of the equalizing signal passage on the pressure-reduced refrigerant outlet space and the valve seat. This makes it easy to work the pressure-reduced refrigerant outlet space and the signal passage.

The pressure-reduced refrigerant outlet space formed like this as the accelerating means is not so shaped as to make the flow of the pressure-reduced refrigerant being turbulent in the pressure-reduced refrigerant outlet space. Therefore, noises can be effectively suppressed while the thermostatic expansion valve is used. It can also effectively prevent the controlling of the flow rate of the refrigerant flowing to the inlet of the evaporator from suddenly changing for a short time period caused by suddenly changing of the pressure in the equalizing signal passage for the short time period.

According to the thermostatic expansion valve having the above-described arrangement, it is preferable that the accelerating means has a member which is arranged in the pressure-reduced refrigerant outlet space between the opening of the equalizing signal passage on the side of the pressure-reduced refrigerant outlet space and the valve seat and which has an opening whose sectional area sectioned in a direction substantially perpendicular to the moving direction of the pressure-reduced refrigerant in the pressure-reduced refrigerant outlet space is made larger than the sectional area of the refrigerant passing hole in the valve seat but smaller than the area of the pressure-reduced refrigerant outlet space at a position remoter from the valve seat than the opening of the equalizing signal passage on the side of the pressure-reduced refrigerant outlet space.

This member of the accelerating means can be independently made from the valve housing. Therefore, it can be easily worked and easily arranged in the pressure-reduced refrigerant outlet space.

In the thermostatic expansion valve characterized by having the above-described arrangement, it is also preferable that the opening of the opening member of the accelerating means has a substantially circular section in a direction substantially perpendicular to the moving direction of the pressure-reduced refrigerant, and the diameter of an upstream side end of the opening, the upstream side end being located at the upstream side in the flowing direction of the pressure-reduced refrigerant passing through the opening, is set smaller than the diameter of a downstream side of the opening, the downstream side end being located at the downstream side in the flowing direction of the pressure-reduced refrigerant passing through the opening.

This opening serves to further reduce the turbulent flow of the pressure-reduced refrigerant passing through the opening.

This opening can be made by a cylindrical portion located at the upstream side in the flowing direction of the pressure-reduced refrigerant passing through the opening, and a circular-truncated-cone shaped portion located at the downstream side therein.

In the thermostatic expansion valve having the above-described arrangement, the accelerating means can be constructed by making the inner circumferential surface of the pressure-reduced refrigerant outlet space including an area where the equalizing signal passage is opened, to have a tapered shape, the diameter of which becomes gradually larger as it goes from the seat valve to the outlet of the pressure-reduced refrigerant outlet space.

The taper-shaped inner circumferential surface of the pressure-reduced refrigerant outlet space can be easily worked through the opening of the space.

DETAILED DESCRIPTION OF THE PREFERRED EMBODIMENTS

Figure 1:
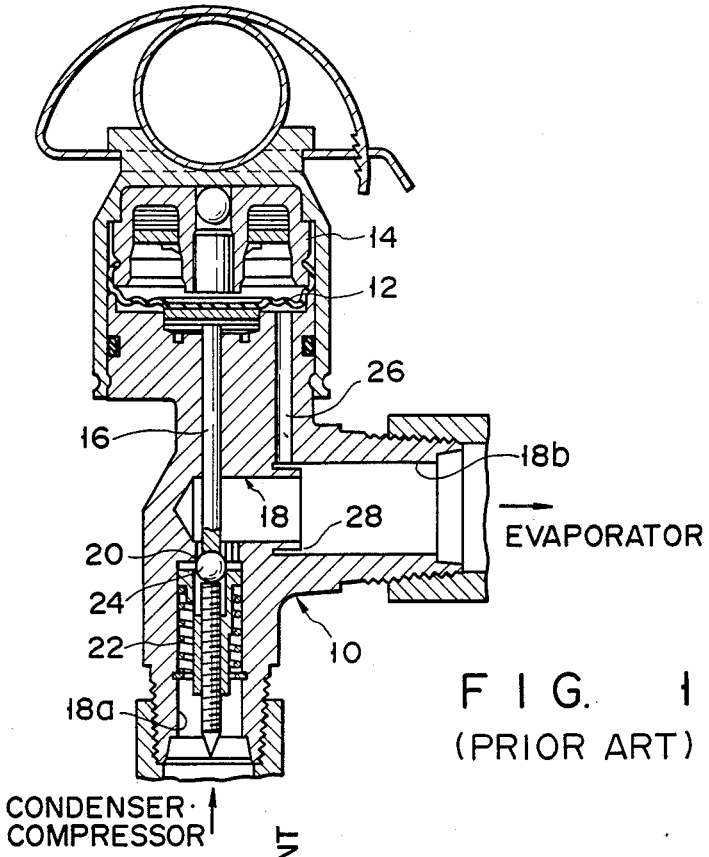
FIG. 1 (PRIOR ART)
FIG. 1 is a longitudinally sectional view schematically showing the conventional thermostatic expansion valve in which an equalizing signal passage is formed in the valve housing.
Figure 2:
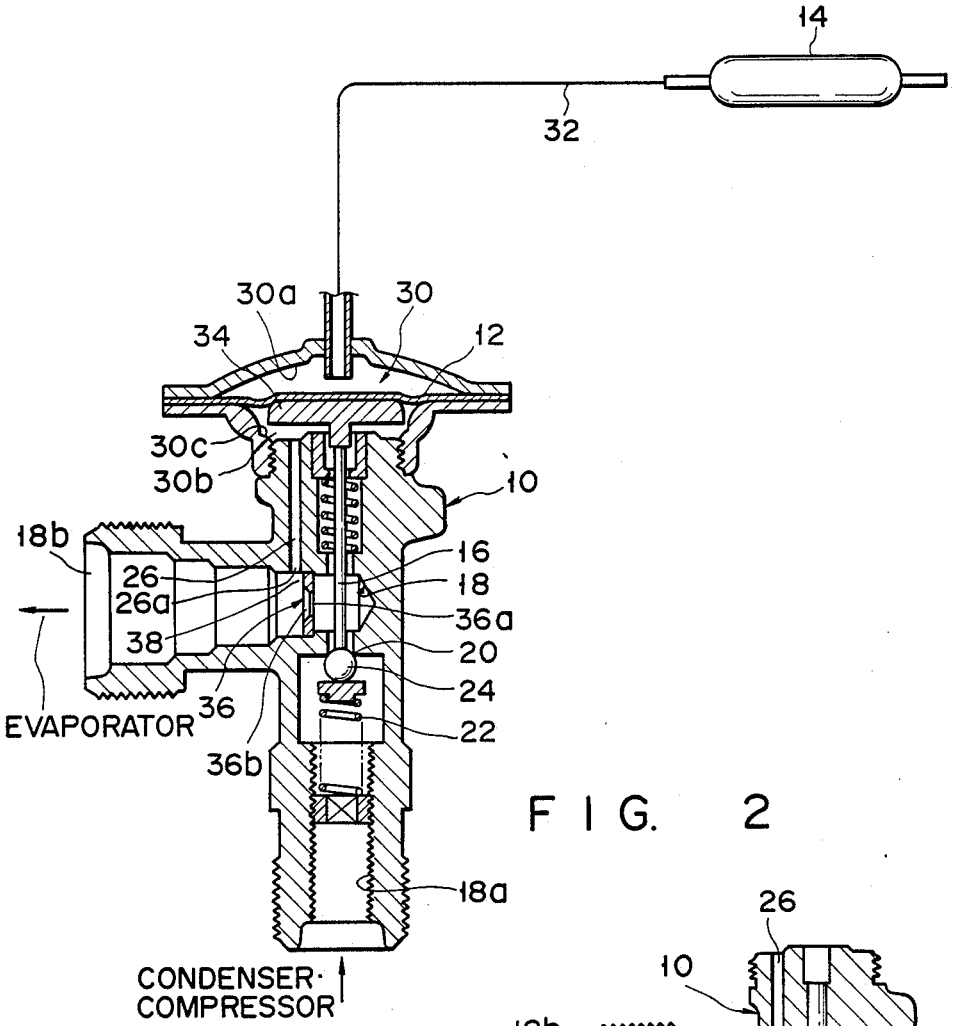
FIG. 2 is a longitudinal sectional view schematically showing a first embodiment of the thermostatic expansion valve according to the present invention.

FIG. 2 schematically shows a longitudinal sectional view of a first embodiment of the thermostatic expansion valve according to the present invention. The same components as those in the case of the conventional thermostatic expansion valve shown in FIG. 1 will be designated by the same reference numerals and the detailed description on these components will be omitted.

Thermal bulb 14 to be located at the outlet of an evaporator of a refrigeration apparatus not shown is not located adjacent to diaphragm 12 housed in sealed space 30 of the upper portion of valve housing 10 but it is communicated through capillary tube 32 with operating fluid chamber **30*a* above diaphragm 12 in sealed space 30. Active carbon and R13 as an operating fluid are sealed in thermal bulb 14**.

Valve drive pin 16 of a valve mechanism is connected to the underside surface of diaphragm 12 through disk-like stopper 34. Stopper 34 can be striken against stepped portion **30*c* formed in equalizing chamber 30*b* located under diaphragm 12 in sealed space 30 to prevent diaphragm 12 from being excessively displaced by the action of the operating fluid in thermal bulb 14**.

According to this embodiment, opening member 38 having opening 36 and serving as the pressure-reduced refrigerant accelerating means is located in side extended area **18*b* which serves as the pressure-reduced refrigerant outlet space in refrigerant passage 18**.

Opening member 38 is independently formed from valve housing 10, and is located between opening **26*a* of equalizing hole 26 on the side of the pressure-reduced refrigerant outlet space and valve seat 20 in side extended area 18*b*, and is fixed thereto to substantially perpendiculary cross the longitudinal center line of side extended area 18*b*. Opening 36 of opening member 38 is coaxially formed with the longitudinal center line and is shaped like a circle having a diameter larger than that of a refrigerant passing hole of valve seat 20 but smaller than that of side extended area 18*b*. Opening 36 comprises cylindrical portion 36*a* located at the upstream side of the flow of the pressure-reduced refrigerant flowing through opening 36 (or at the side of the valve seat), and circular-truncated-cone shaped portion 36*b* located at the down-stream side (or at the side of the equalizing signal passage). The diameter of opening 36 at the upstream side is smaller than that of opening 36** at the downstream side.

The sectional area of side extended area **18*b* of refrigerant passage 18 in a direction perpendicular to the longitudinal center line is about 25.3 $mm^2$ between opening member 38 and valve seat 20 and about 40.2 $mm^2$ at the position of opening 26*a* of equalizing signal passage 26. The sectional area of the refrigerant passing hole in valve seat 20 ranges from about 1.3 $mm^2$ to about 2.7 $mm^2$. (In other words, it is about 1.3 $mm^2$ at the time of the standard flow rate and it is about 2.7 $mm^2$ at the time of maximum flow rate). The diameter of opening 36 is about 2.0 mm at its cylindrical portion 36*a* and about 2.5 mm at maximum point in its circular-truncated-cone shaped section 36*b*. The thickness of opening member 38** is about 1.0 mm.

Side extended area **18*ab* is constructed as a hole having plural steps, and the diameter of each of the stepped portions becomes larger as it comes nearer the outlet of side extended area 18*b*. Opening member 38 contacts at its peripheral edge the innermost stepped portion of side extended area 18*b* to be fixed at a certain position in a certain posture in side extended area 18*b***.

According to the first embodiment of the thermostatic expansion valve having the above-described arrangement, refrigerant, which has been reduced in pressure by passing through valve seat 20 and which flows into side extended area **18*b* of refrigerant passage 18, increases its velocity immediately after it passes through opening 36 of opening member 38. According to Bernoulli's theorem, this increase in velocity of the pressure-reduced refrigerant lowers the pressure of refrigerant which is stored in a stationary state in equalizing signal passage 26, opening 26*a* of which is opened adjacent to the downstream-side opening of opening member 38 in the inner circumferential surface of side extended area 18*b*. The pressure in equalizing signal passage 26, or pressure loaded on the underside surface of diaphragm 12 in equalizing chamber 30*b* (below diaphragm 12), thus becomes lower as the flow rate of the pressure-reduced refrigerant flowing into side extended area 18*b* becomes larger and the velocity of the refrigerant increases immediately after it passes through opening 36 of opening member 38**.

Figure 3:
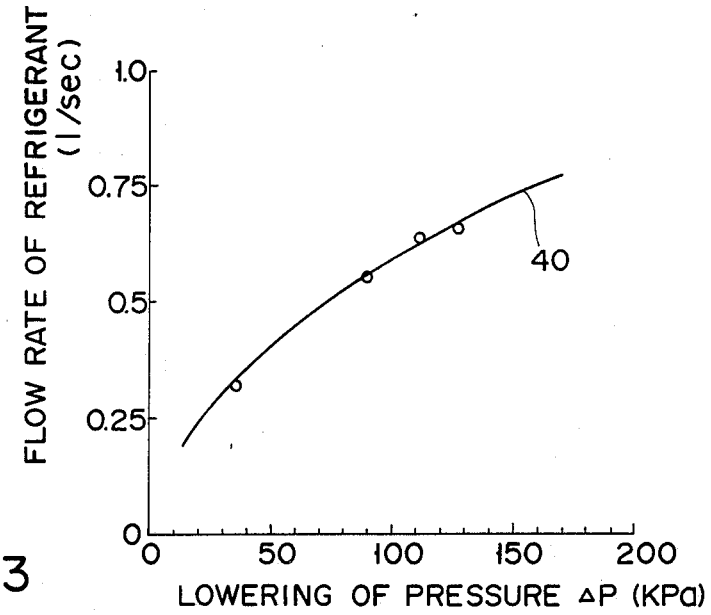
FIG. 3 is a graph schematically showing the relation of the pressure decrease of refrigerant with the flow rate thereof in the thermostatic expansion valve shown in FIG. 2.

Solid line 40 in FIG. 3 shows how the pressure of superheated refrigerant vapor at the outlet of the evaporator is lowered when the flow rate of the pressure-reduced reduced refrigerant flowing into side extended area **18*b* and then toward the inlet of the evaporator increases. The relationship between increase of the flow rate and the lowering of pressure in equalizing signal passage 26 is also shown by dots in FIG. 3. As apparent from FIG. 3, the first embodiment of the thermostatic expansion valve shown in FIG. 2 can operate the same as in the case of the conventional thermostatic expansion valve which uses, instead of equalizing signal passage 26 formed in valve housing 10 of the first embodiment, the outer equalizing capilary tube for introducing the superheated refrigerant vapor at the outlet of the evaporator to equalizing chamber 30*b* under diaphragm 12**.

Figure 4:
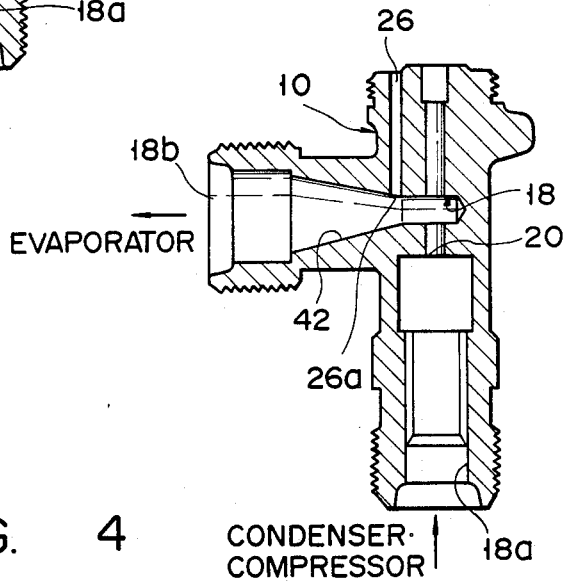
FIG. 4 is a longitudinal sectional view schematically showing the main portion of a second embodiment of the thermostatic expansion valve according to the present invention.

FIG. 4 schematically shows a longitudinal sectional view of a valve housing which is the main portion of a second embodiment of the thermostatic expansion valve according to the present invention. The same components as those in the conventional thermostatic expansion valve shown in FIG. 1 will be designated by the same reference numerals and the detailed description on these components will be omitted. Side extended area **18*b* of refrigerant passage 18 in valve housing 10 includes tapered portion 42 whose diameter becomes gradually larger as it comes nearer the outlet of side extended area 18*b*. Tapered portion 42 is formed from a position, which is in the vicinity of opening 26*a* of equalizing signal passage 26 and is nearer to valve seat 20 than opening 26*a*, toward the outlet of side extended area 18*b*. That portion of side extended area 18*b* which is located between valve seat 20 and tapered portion 42 does not change its diameter, or has the same diameter. For example, the sectional area of this same-diameter portion located upstream side of tapered portion 42 is about 8.7 $mm^2$, the length of tapered portion 42 is about 1.4 mm, the sectional area of the valve-seat side end of tapered portion 42 is about 8.7 $mm^2$, and that of the other side end of tapered portion 42 which is located on the outlet side of side extended area 18*b*** is about 78.5 $mm^2$.

Also in the case of this second embodiment, refrigerant, which has been reduced in pressure while passing through valve seat 20 and then flows into side extended area **18*b* of refrigerant passage 18, makes its velocity higher when it flows along the inner circumferential surface of tapered portion 42 than when along the longitudinal center line thereof. According to Bernoulli's theorem, this increase in velocity of the pressure-reduced refrigerant lowers the pressure of refrigerant which stored in a stationary state in equalizing signal passage 26, opening 26*a* which is opened at the inner circumferential surface of side extended area 18*b* in tapered portion 42 but in the vicinity of the valve-seat side end thereof. The pressure in equalizing signal passage 26, (or pressure loaded on the underside surface of diaphragm 12 in equalizing chamber 30*b*), therefore, becomes lower as the flow rate of the pressure-reduced refrigerant flowing into side extended area 18*b* becomes larger and the velocity of the refrigerant along the inner peripheral surface of tapered portion 42** thus becomes higher.

This second embodiment can operate the same as the first one shown in FIG. 2. Therefore, the second embodiment can operate the same as the conventional thermostatic expansion valve which uses, instead of equalizing signal passage 26 formed in valve housing 10 of the second embodiment, the outer equalizing capilary tube for introducing the superheated refrigerant vapor at the outlet of the evaporator to equalizing chamber **30*b* under diaphragm 12**.

When the second embodiment of the thermostatic expansion valve shown in FIG. 4 is compared with the first one shown in FIG. 2, the former is inferior in the degree of lowering the pressure in equalizing signal passage 26 per a certain velocity of the refrigerant in side extended area **18*b* but more superior in suppressing noises caused by a turbulent flow of the refrigerant in side extended area 18*b***.

What is claimed is:

1. A thermostatic expansion valve which is used in a refrigeration apparatus and is provided with a diaphragm, serving to receive at one side surface thereof the pressure of operating fluid fed from a thermal bulb located at the outlet of an evaporator in the refrigeration apparatus and connected at the other side surface thereof to a valve mechanism, and which is intended to control the valve mechanism responsive to a change in a difference between the pressure applied to the one and the other side surfaces of the diaphragm by the displacement of the diaphragm owing to the pressure difference and to control the flow rate of refrigerant flowing into the evaporator, said thermostatic expansion valve comprising:

a valve housing which serves to support the diaphragm and has a refrigerant passage connected at its one end to the inlet of the evaporator and supplied at its the other end with high pressurized refrigerant flowing from a compressor in the refrigeration apparatus, a valve seat formed in the refrigerant passage to control the flow rate of the refrigerant flowing from the compressor, in co-operation with a valve body of the valve mechanism, and an equalizing signal passage for introducing the pressure-reduced refrigerant, which has been reduced in pressure by the cooperation of the valve body of the valve mechanism with the valve seat in the refrigerant passage, from a pressure-reduced refrigerant outlet space located at the downstream side of the valve seat in the refrigerant passage to the other side surface of the diaphragm; and means, located in the pressure-reduced refrigerant outlet space, for accelerating the velocity of the pressure-reduced refrigerant;

wherein said accelerating means is constructed by setting a sectional area of the pressure-reduced refrigerant outlet space in a direction substantially perpendicular to the moving direction of the pressure-reduced refrigerant larger than the sectional area of a refrigerant passing hole in the valve seat between the opening of the equalizing signal passage on the side of the pressure-reduced outlet space and the valve seat, but smaller than the sectional area of the pressure-reduced refrigerant outlet space at a position remoter from the valve seat than the opening of the equalizing signal passage on the side of the pressure-reduced refrigerant outlet space.

2. The thermostatic expansion valve according to claim 1, wherein said accelerating means includes a member which is arranged in the pressure-reduced refrigerant outlet space between the opening of the equalizing signal passage on the side of the pressure-reduced refrigerant outlet space and the valve seat and which has an opening whose sectional area sectioned in a direction substantially perpendicular to the moving direction of the pressure-reduced refrigerant in the pressure-reduced refrigerant outlet space is larger than the sectional area of the refrigerant passing hole in the valve seat but smaller than the sectional area of the pressure-reduced refrigerant outlet space at a position remoter from the valve seat than the opening of the equalizing signal passage on the side of the pressure-reduced refrigerant outlet space.

3. The thermostatic expansion valve according to claim 2, wherein the opening of the opening member of said accelerating means has a substantially circular section in a direction substantially perpendicular to the moving direction of the pressure-reduced refrigerant, and the diameter of an upstream side end of said opening, the upstream side end being located at the upstream side in the flowing direction of the pressure-reduced refrigerant passing through the opening, is made smaller than the diameter of a downstream side of said opening, the downstream side end being located at the downstream side in the flowing direction of the pressure-reduced refrigerant passing through the opening.

4. The thermostatic expansion valve according to claim 3, wherein the opening of the opening member of said accelerating means comprises a cylindrical portion located at the upstream side in the flowing direction of the pressure-reduced refrigerant passing through the opening, and a circular-truncated-cone shaped portion located at the downstream side therein.

5. The thermostatic expansion valve according to claim 1, wherein said accelerating means is constructed by making the inner circumferential surface of the pressure-reduced refrigerant outlet space including an area where the equalizing signal passage is opened to have a tapered shape, the diameter of which becomes gradually larger as it goes from the seat valve to the outlet of the pressure-reduced refrigerant outlet space.

6. The valve as claimed in claim 1, wherein the equalizing signal passage has an opening in said outlet space intermediate the upstream end of said accelerating means and the outlet end of said outlet space, said equalizing signal passage opening being located in the path of pressure reduced refrigerant flowing through said outlet space.

* * * * *